US010372049B2

(12) United States Patent
Kawasaki et al.

(10) Patent No.: US 10,372,049 B2
(45) Date of Patent: Aug. 6, 2019

(54) ELECTROPHOTOGRAPHIC PHOTORECEPTOR, PROCESS CARTRIDGE, AND IMAGE-FORMING APPARATUS

(71) Applicant: FUJI XEROX CO., LTD., Tokyo (JP)

(72) Inventors: Akihiro Kawasaki, Kanagawa (JP); Hirofumi Nakamura, Kanagawa (JP); Yohei Saito, Kanagawa (JP); Keisuke Kusano, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/699,368

(22) Filed: Sep. 8, 2017

(65) Prior Publication Data

US 2018/0275538 A1 Sep. 27, 2018

(30) Foreign Application Priority Data

Mar. 22, 2017 (JP) ..... 2017-056195

(51) Int. Cl.

| | |
|---|---|
| ***G03G 5/10*** | (2006.01) |
| ***G03G 5/06*** | (2006.01) |
| ***G03G 5/05*** | (2006.01) |
| ***G03G 5/04*** | (2006.01) |
| *G03G 21/18* | (2006.01) |

(52) U.S. Cl.

CPC ..... *G03G 5/102* (2013.01); *G03G 5/04* (2013.01); *G03G 5/0564* (2013.01); *G03G 5/0592* (2013.01); *G03G 5/0609* (2013.01); *G03G 5/0614* (2013.01); *G03G 5/0618* (2013.01); *G03G 5/0631* (2013.01); *G03G 5/0668* (2013.01); *G03G 5/0672* (2013.01); *G03G 5/0677* (2013.01); *G03G 5/0696* (2013.01); *G03G 21/18* (2013.01)

(58) Field of Classification Search

CPC ..... G03G 5/102; G03G 5/10; G03G 5/04; G03G 5/0564

USPC ..... 430/69

See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,459,004 | A | 10/1995 | Daimon et al. | |
| 5,573,445 | A * | 11/1996 | Rasmussen | B08B 3/12 430/127 |
| 2013/0288169 | A1* | 10/2013 | Yamano | G03G 5/0607 430/56 |
| 2017/0045833 | A1* | 2/2017 | Sato | G03G 5/005 |

FOREIGN PATENT DOCUMENTS

| | | | |
|---|---|---|---|
| JP | 4-189873 | A | 7/1992 |
| JP | 5-098181 | A | 4/1993 |
| JP | 05-140472 | A | 6/1993 |
| JP | 05-140473 | A | 6/1993 |
| JP | 5-263007 | A | 10/1993 |
| JP | 5-279591 | A | 10/1993 |
| JP | 2004-078147 | A | 3/2004 |
| JP | 2005-181992 | A | 7/2005 |
| JP | 2016-066062 | A | 4/2016 |

OTHER PUBLICATIONS

Japanese Patent Office J-PlatPat machine-assisted English-language translation of JP 2016-066062 A (pub. Apr. 2016).*

Whelan, T., ed., Polymer Technology Dictionary, Chapman & Hall, London (1994), p. 486.*

* cited by examiner

*Primary Examiner* — Janis L Dote

(74) *Attorney, Agent, or Firm* — Sughrue Mion, PLLC

(57) ABSTRACT

An electrophotographic photoreceptor includes a conductive support and a single-layer photosensitive layer. The conductive support has an outer peripheral surface with a maximum surface roughness height (Rmax) of about 4.0 μm or less, and the outer peripheral surface has a recess with a depth-to-aperture size ratio (depth/aperture size) of about 0.03 or more and about 0.12 or less. The single-layer photosensitive layer is disposed on the conductive support and has a thickness of about 20 μm or more and a modulus of elasticity of about 4.5 GPa or more.

12 Claims, 5 Drawing Sheets

ELECTROPHOTOGRAPHIC PHOTORECEPTOR, PROCESS CARTRIDGE, AND IMAGE-FORMING APPARATUS

CROSS-REFERENCE TO RELATED APPLICATIONS

This application is based on and claims priority under 35 USC 119 from Japanese Patent Application No. 2017-056195 filed Mar. 22, 2017.

BACKGROUND

TECHNICAL FIELD

The present invention relates to an electrophotographic photoreceptor, a process cartridge, and an image-forming apparatus.

SUMMARY

According to an aspect of the invention, there is provided an electrophotographic photoreceptor including a conductive support having an outer peripheral surface with a maximum surface roughness height (Rmax) of about 4.0 μm or less, the outer peripheral surface having a recess with a depth-to-aperture size ratio (depth/aperture size) of about 0.03 or more and about 0.12 or less, and a single-layer photosensitive layer disposed on the conductive support and having a thickness of about 20 μm or more and a modulus of elasticity of about 4.5 GPa or more.

BRIEF DESCRIPTION OF THE DRAWINGS

Exemplary embodiments of the present invention will be described in detail based on the following figures, wherein.

DETAILED DESCRIPTION

Exemplary embodiments of the invention will now be described. The description and examples below are illustrative of the exemplary embodiments and are not intended to limit the scope of the invention.

In the present specification, if there are two or more substances corresponding to one component in a composition, the amount of the component in the composition refers to the total amount of the two or more substances in the composition, unless otherwise specified.

In the present specification, an "electrophotographic photoreceptor" is also referred to simply as a "photoreceptor".

Electrophotographic Photoreceptor

A photoreceptor according to an exemplary embodiment includes a conductive support and a photosensitive layer disposed on the conductive support. The conductive support has an outer peripheral surface with a maximum surface roughness height (Rmax) of 4.0 μm or less or about 4.0 μm or less, and the outer peripheral surface has a recess with a depth-to-aperture size ratio (depth/aperture size) of 0.03 or more and 0.12 or less, or about 0.03 or more and about 0.12 or less. The photosensitive layer has a thickness of 20 μm or more or about 20 μm or more and a modulus of elasticity of 4.5 GPa or more or about 4.5 GPa or more.

The maximum surface roughness height (Rmax) of the outer peripheral surface of the conductive support is a "maximum height (Rmax)" specified in JIS B0601 (1982). The maximum height (Rmax) is measured using a SURFCOM 1400A surface roughness meter (Tokyo Seimitsu Co., Ltd.) in accordance with JIS B0601 (1982) under the following conditions: evaluation length Ln=4.0 mm, sampling length L=0.8 mm, cutoff value=0.8 mm.

Hereinafter, the maximum surface roughness height (Rmax) of the outer peripheral surface of the conductive support is also referred to simply as the "maximum height of the conductive support".

The "aperture size" of a recess refers to a major axis of an aperture, and the major axis refers to a maximum length among distances between randomly selected two points on a contour. The "depth" of a recess refers to a distance from an aperture plane to the deepest point of the recess.

The "aperture size" and the "depth" of recesses are measured as follows. The whole outer peripheral surface of a conductive support is examined using an automatic surface tester to obtain a recess distribution data. The recesses are then located based on the recess distribution data, while recesses having an aperture size of 100 μm or more are measured for their aperture size and depth using a laser microscope.

Hereinafter, the depth-to-aperture size ratio (depth/aperture size) is also referred to as the "aspect ratio".

Figure 1:
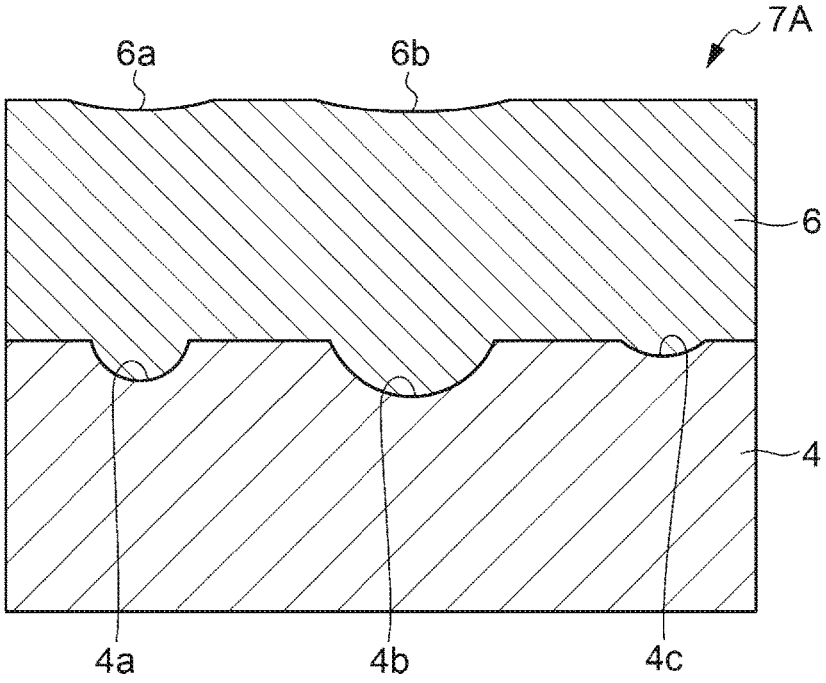
FIG. 1 is a schematic partial sectional view illustrating an example of the layer structure of an electrophotographic photoreceptor according to an exemplary embodiment.

The photoreceptor according to the exemplary embodiment will now be described with reference to FIG. 1. FIG. 1 is a schematic partial sectional view illustrating an example of the layer structure of the photoreceptor.

A photoreceptor 7A shown in FIG. 1 has a structure in which a single-layer photosensitive layer 6 is disposed on a conductive support 4. Other layers such as an undercoat layer and an intermediate layer may be disposed between the conductive support 4 and the single-layer photosensitive layer 6. Furthermore, other layers such as a protective layer may be disposed on the outer peripheral surface of the single-layer photosensitive layer 6. These other layers are optional.

In the photoreceptor 7A, the outer peripheral surface of the conductive support 4 is dotted with recesses 4*a*, 4*b*, and 4*c*. Each of the recesses 4*a*, 4*b*, and 4*c* has an aspect ratio of 0.03 or more and 0.12 or less, or about 0.03 or more and about 0.12 or less.

The single-layer photosensitive layer 6 is dotted with recesses 6*a* and 6*b*, which are reflected by the recesses 4*a* and 4*b* in the outer peripheral surface of the conductive support 4. Each of the recesses 6*a* and 6*b* has an aspect ratio of 0.030 or less.

The photoreceptor according to the exemplary embodiment causes few or no point defects in an image. This is presumably due to the following reason.

One known working process for producing a conductive support for a photoreceptor is impact pressing, but a conductive support produced by impact pressing may have very small recesses in its outer peripheral surface. Impact pressing is a working process involving placing a metal slug in a circular female die and striking the metal slug with a cylindrical male die to form a hollow cylindrical body. Presumably, since a surface of the metal slug becomes the outer peripheral surface of the hollow cylindrical body, projections and recesses, if present on and in the surface of the metal slug, will be projections and recesses on and in the outer peripheral surface of the hollow cylindrical body. The projections are flattened afterward by ironing or other processing, but the recesses will remain in the outer peripheral surface of the hollow cylindrical body, that is, the outer peripheral surface of the conductive support.

When there are recesses in the outer peripheral surface of the conductive support, recesses reflected by the recesses in the outer peripheral surface of the conductive support may appear in the outer peripheral surface of the outermost layer of a photoreceptor obtained by disposing various layers on the conductive support. Furthermore, when a high-density image is formed using a photoreceptor having recesses in the outer peripheral surface of the outermost layer, point defects may occur in the image at points corresponding to the recesses in the outer peripheral surface of the outermost layer. As the aperture size or aspect ratio of the recesses in the outer peripheral surface of the outermost layer increases, point defects become more likely to occur.

In the case of a single-layer photosensitive layer, as compared with the case of a stacked (i.e., multilayer) photosensitive layer, the outer peripheral surface of the photosensitive layer particularly tends to be reflected by the recesses of the conductive support, and recesses having a high aspect ratio tend to appear in the outer peripheral surface of the photosensitive layer.

Specifically, for example, in the case of a stacked photosensitive layer, each time a layer is disposed, the aspect ratio of recesses that appear in the outer peripheral surface of the layer becomes lower. Thus, when the maximum height of the conductive support is 4.0 μm or less, the outer peripheral surface of the photosensitive layer is not reflected by the recesses of the conductive support, or recesses, if present reflected by the recesses of the conductive support, have a low aspect ratio, and as a result, few or no point defects occur in an image.

However, in the case of a single-layer photosensitive layer, the number of layers disposed on the conductive support is small, and thus the aspect ratio of recesses that appear in the outer peripheral surface of the layer disposed is less likely to be low. Thus, even if the maximum height of the conductive support is 4.0 μm or less, when recesses having an aspect ratio of 0.03 or more and 0.12 or less are present in the outer peripheral surface of the conductive support, the recesses tend to reflect on the outer peripheral surface of the photosensitive layer, and point defects may occur.

In contrast, the photoreceptor according to the exemplary embodiment includes a conductive support having a maximum height of 4.0 μm or less or about 4.0 μm or less and a single-layer photosensitive layer having a thickness of 20 μm or more or about 20 μm or more and a modulus of elasticity of 4.5 GPa or more or about 4.5 GPa or more. That is to say, due to the configuration in which a single-layer photosensitive layer having a modulus of elasticity of 4.5 GPa or more or about 4.5 GPa or more is disposed on the outer peripheral surface of a conductive support having a maximum height of 4.0 μm or less or about 4.0 μm or less such that the single-layer photosensitive layer has a thickness of 20 μm or more or about 20 μm or more, the photosensitive layer has a flat outer peripheral surface and recesses having a high aspect ratio are less likely to appear in the outer peripheral surface of the photosensitive layer. For this reason, it is presumed that although recesses having an aspect ratio of 0.03 or more and 0.12 or less, or about 0.03 or more and about 0.12 or less, are present on the outer peripheral surface of the conductive support and the photosensitive layer is of single-layer type, no recesses appear in the outer peripheral surface of the photosensitive layer, or recesses, if present, have a low aspect ratio, and as a result, few or no point defects occur.

As described above, in the photoreceptor 7A shown in FIG. 1, other layers may be, but not necessarily, disposed between the conductive support 4 and the single-layer photosensitive layer 6 or on the outer peripheral surface of the single-layer photosensitive layer 6. In the exemplary embodiment, although the photoreceptor 7A, as shown in FIG. 1, includes the conductive support 4, the single-layer photosensitive layer 6, and no other layers, few or no point defects occur because the maximum height of the conductive support 4 and the thickness and the modulus of elasticity of the single-layer photosensitive layer 6 are within the above-described ranges.

The layers of the electrophotographic photoreceptor according to the exemplary embodiment will now be described in detail. Reference numerals are omitted in the description.

Conductive Support

"Conductive" in the conductive support according to the exemplary embodiment refers to having a volume resistivity of less than $10^{13}$ Ωcm.

The conductive support is, for example, a cylindrical member, and may be a hollow member or a solid member. To provide a lighter photoreceptor, the conductive support is preferably a hollow member. When the conductive support is a hollow member, its thickness (wall thickness) is preferably 0.9 mm or less or about 0.9 mm or less, more preferably 0.8 mm or less or about 0.8 mm or less, to provide a lighter photoreceptor, and the thickness is preferably 0.2 mm or more or about 0.2 mm or more, more preferably 0.4 mm or more or about 0.4 mm or more, to provide the conductive support with sufficient strength.

In particular, the thickness of the conductive support is preferably 0.4 mm or more and 0.6 mm or less, or about 0.4 mm or more and about 0.6 mm or less, more preferably 0.45 mm or more and 0.55 mm or less, or about 0.45 mm or more and about 0.55 mm or less. A thickness of the conductive support in this range, compared with a thickness below this range, readily provides a photoreceptor with sufficient strength and, compared with a thickness over this range, provides the conductive support with appropriate hardness and higher shock absorption, thus reducing scratches and peeling of the photosensitive layer.

Examples of the metal forming the conductive support include pure metals such as aluminum, iron, and copper; and alloys such as stainless steel and aluminum alloys. The metal forming the conductive support is preferably an aluminum-containing metal because of its lightweight and high workability, more preferably pure aluminum or an aluminum alloy. The aluminum alloy may be any alloy as long as it contains aluminum as a principal component and may contain, in addition to aluminum, Si, Fe, Cu, Mn, Mg, Cr, Zn, and Ti, for example. "Principal component" as used herein refers to an element contained in the largest amount (by weight) among the elements contained in the alloy. From the viewpoint of workability, the metal forming the conductive support is preferably a metal with an aluminum content (by weight) of 90.0% or more. The aluminum content is more preferably 95.0% or more, still more preferably 99.0% or more.

The conductive support is produced, for example, by a known formation process such as pultrusion, drawing, impact pressing, ironing, or cutting. To have a thin wall and high hardness, the conductive support is preferably produced by impact pressing, more preferably produced by impact pressing and subsequent ironing. In other words, the conductive support is preferably an impact-pressed product or an ironed impact-pressed product.

Impact pressing is a working process involving placing a metal slug in a circular female die and striking the metal slug with a cylindrical male die to form a hollow cylindrical body conforming to the male die. After the hollow cylindrical body is formed by impact pressing, ironing is performed one or more times to adjust the inner diameter, the outer diameter, the cylindricity, and the roundness of the hollow cylindrical body, to thereby obtain a conductive support. After the ironing, the resulting cylindrical tube may be cut at both ends and further subjected to end face treatment. Exemplary embodiments of impact pressing and ironing will be described below.

Impact Pressing

Figure 2A:
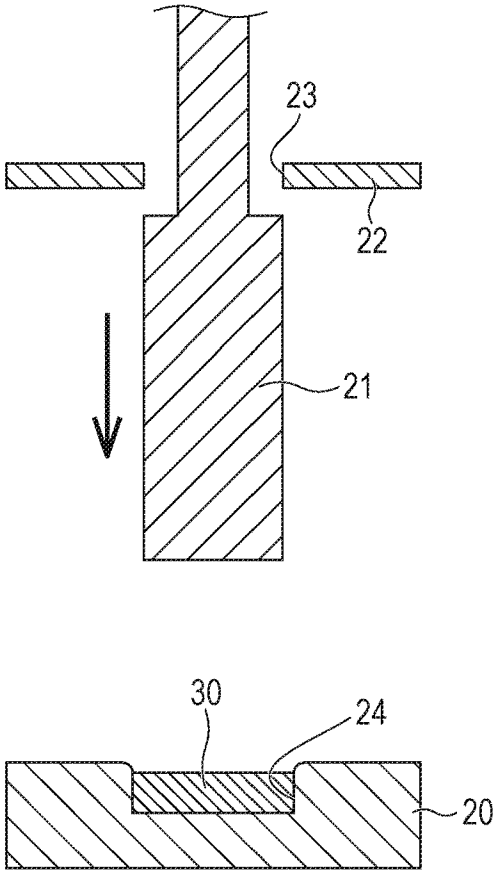
FIGS. 2A to 2C schematically illustrate an exemplary process of impact pressing for forming a conductive support.
Figure 2B:
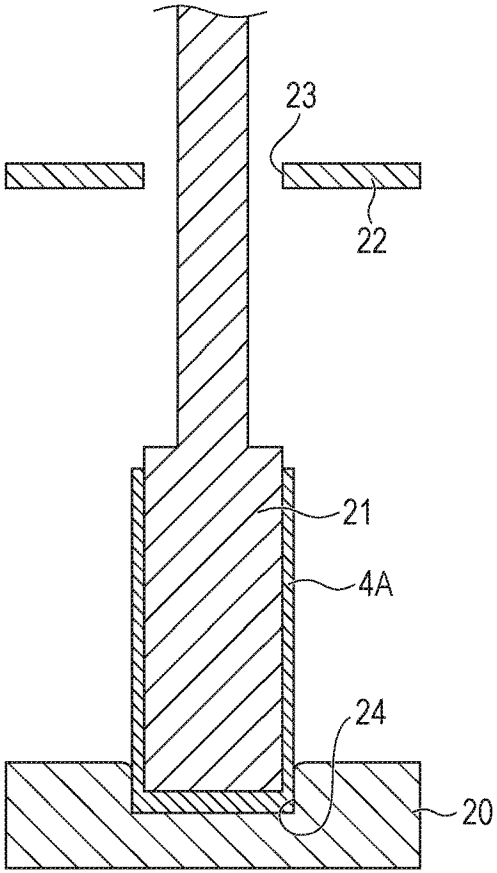
Figure 2C:
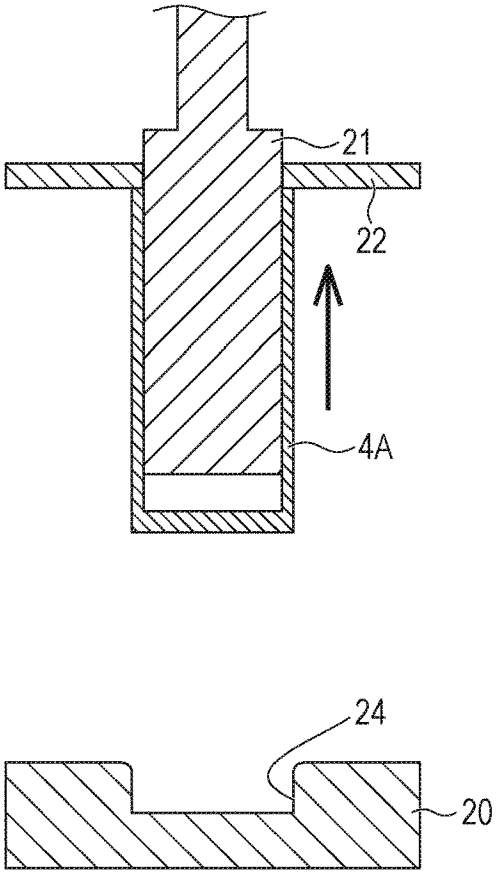

FIGS. 2A to 2C illustrate an exemplary process of forming a hollow cylindrical body by subjecting a metal slug to impact pressing. As shown in FIG. 2A, a disk-shaped metal slug 30 to which surface a lubricant is applied is placed in a circular hole 24 in a die (female die) 20. Next, as shown in FIG. 2B, a cylindrical punch (male die) 21 is pressed against the metal slug 30 to form a hollow cylindrical body 4A. Next, as shown in FIG. 2C, the punch 21 is pulled up through a central hole 23 in a stripper 22 to draw the punch 21 out of the hollow cylindrical body 4A.

In the impact pressing, the metal slug 30 pressed by the punch 21 is stretched into a cylindrical shape so as to surround the punch 21, and as a result, the hollow cylindrical body 4A is formed. Therefore, a surface of the metal slug 30 (particularly, a surface that faces downward when the metal slug 30 is placed in the circular hole 24) becomes the outer peripheral surface of the hollow cylindrical body 4A. Thus, projections and recesses on and in the surface of the metal slug 30 reflect projections and recesses on and in the outer peripheral surface of the hollow cylindrical body 4A.

Preferably, a lubricant is applied to the surface of the metal slug 30. The lubricant may reduce the friction between the punch 21 and the metal slug 30, so that the metal slug 30 is more uniformly stretched so as to surround the punch 21, resulting in reduced projections and recesses on and in the outer peripheral surface of the hollow cylindrical body 4A.

Examples of the lubricant applied to the surface of the metal slug 30 include fatty acid metal salts (e.g., zinc stearate, aluminum stearate, sodium stearate, magnesium stearate, zinc laurate, and potassium laurate); esters of long-chain fatty acids and polyhydric alcohols (e.g., esters of fatty acids having 5 to 22 carbon atoms and polyhydric alcohols such as neopentyl glycol, trimethylolpropane, and pentaerythritol); and liquid hydrocarbon polymers (e.g., copolymers of polybutene, polyisobutylene, isobutene, and n-butene, copolymers of isobutene and isopropylene, copolymers of isobutene and butadiene, copolymers of n-butene and styrene, and copolymers of n-butene and isopropylene). To achieve reduced projections and recesses on and in the outer peripheral surface of the hollow cylindrical body 4A, the lubricant applied to the surface of the metal slug 30 is preferably a fatty acid metal salt.

To achieve reduced projections and recesses on and in the outer peripheral surface of the hollow cylindrical body 4A, the amount of lubricant applied is preferably 0.15 mg/cm$^2$ or more and 0.5 mg/cm$^2$ or less, more preferably 0.2 mg/cm$^2$ or more and 0.4 mg/cm$^2$ or less.

The material, shape, size, and other characteristics of the metal slug 30 may be selected according to the material, shape, size, and other characteristics of a conductive support to be produced. The metal slug 30 is preferably made of pure aluminum or an aluminum alloy, because of their high workability. From the viewpoint of workability, the aluminum content (by weight) of the metal slug 30 is preferably 90.0% or more, more preferably 95.0% or more, still more preferably 99.0% or more.

The metal slug 30 may be subjected to surface modification in order to control the crystal grain size near the surface of the metal slug 30. Examples of the surface modification include quenching, nitriding, and burnishing.

The thickness of the hollow cylindrical body 4A is selected according to the inner diameter, outer diameter, and wall thickness of a conductive support to be produced, the number of times of subsequent ironing, and other factors.

The hollow cylindrical body 4A may be subjected to annealing before ironing.

Ironing

Figure 3B:
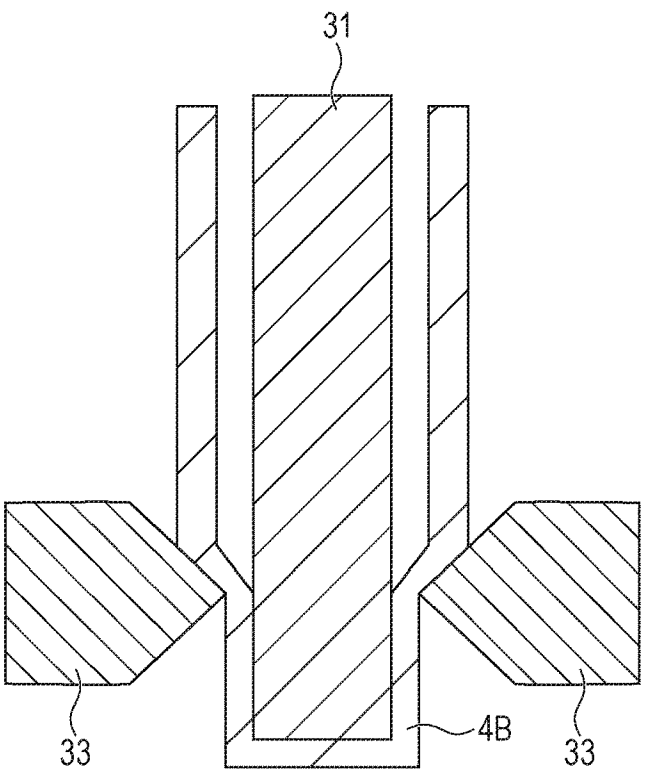
FIGS. 3A and 3B schematically illustrate an exemplary process of ironing for forming a conductive support.
Figure 3A:
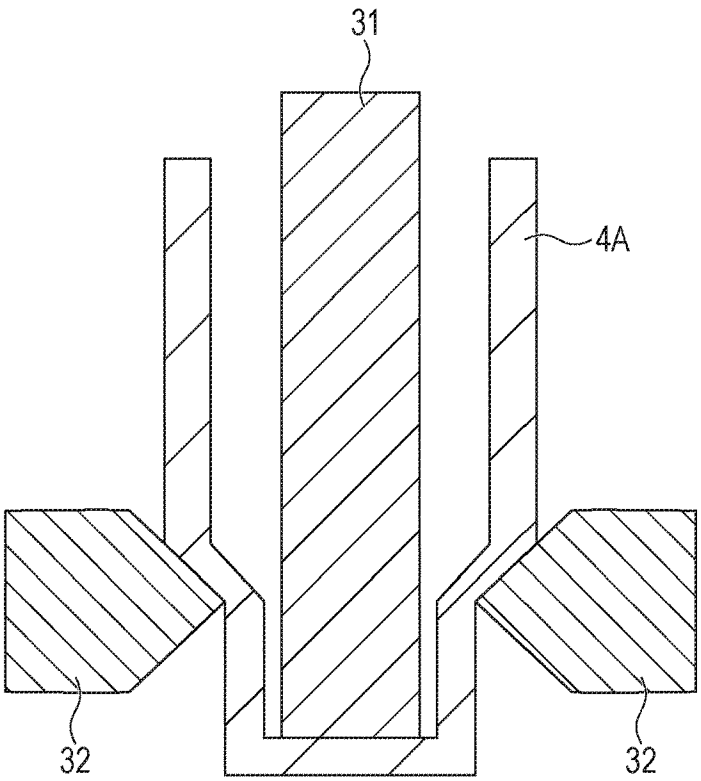

FIGS. 3A and 3B illustrate an exemplary process of subjecting the hollow cylindrical body to ironing. In the exemplary process, drawing is performed (FIG. 3A), and then ironing is performed (FIG. 3B).

As shown in FIG. 3A, a cylindrical punch 31 is inserted into the hollow cylindrical body 4A, and the punch 31, together with the hollow cylindrical body 4A, is pressed into a die 32 having a smaller diameter than the hollow cylindrical body 4A to thereby reduce the diameter of the hollow cylindrical body 4A. Next, as shown in FIG. 3B, the punch 31, together with the hollow cylindrical body 4A, is pressed into a die 33 having a smaller diameter than the die 32 to obtain a hollow cylindrical body 4B having a smaller wall thickness than the hollow cylindrical body 4A. The ironing may be performed without performing the drawing, or the ironing may be performed in multiple stages. As a result of subjecting the hollow cylindrical body 4A to the ironing, projections on the outer peripheral surface of the hollow cylindrical body 4A are flattened.

The conductive support may be subjected to a known surface treatment such as anodic oxidation, pickling, or boehmite treatment.

Outer Peripheral Surface of Conductive Support

The maximum height of the conductive support is 4.0 μm or less or about 4.0 μm or less, as described above, and the maximum height is preferably 3.0 μm or more and 4.0 μm or less, or about 3.0 μm or more and about 4.0 μm or less. A maximum height of the conductive support of 3.0 μm or more reduces the possibility of interference fringes which may cause image density unevenness.

To prevent or reduce point defects and interference fringes which may cause image density unevenness, the maximum height of the conductive support is more preferably 3.0 μm or more and 3.8 μm or less, or about 3.0 μm or more and about 3.8 μm or less, still more preferably 3.2 μm or more and 3.6 μm or less, or about 3.2 μm or more and about 3.6 μm or less.

In the outer peripheral surface of the conductive support, at least recesses having an aspect ratio of 0.03 or more and 0.12 or less, or about 0.03 or more and about 0.12 or less, may be present, but recesses having an aspect ratio of more than 0.12 or about 0.12 are preferably absent. That is to say, the maximum value of the aspect ratio (hereinafter also referred to as the "maximum aspect ratio") of recesses in the outer peripheral surface of the conductive support is preferably 0.12 or less or about 0.12 or less. When the maximum aspect ratio is 0.12 or less or about 0.12 or less, fewer point defects occur in an image than when recesses having an aspect ratio of more than 0.12 or about 0.12 are present. To prevent or reduce point defects, the maximum aspect ratio is more preferably 0.11 or less or about 0.11 or less, still more preferably 0.10 or less or about 0.10 or less. The maximum aspect ratio is preferably as low as possible in order to prevent or reduce point defects, but if the maximum aspect ratio is 0.06 or more or about 0.06 or more, for example, the occurrence of point defects is prevented or reduced by disposing a single-layer photosensitive layer having a modulus of elasticity and a thickness within the above ranges as described above.

In the outer peripheral surface of the conductive support, recesses having an aperture size of more than 400 μm are preferably absent. That is to say, the maximum value of the aperture size (hereinafter also referred to as the "maximum aperture size") of recesses in the outer peripheral surface of the conductive support is preferably 400 μm or less. When the maximum aperture size is 400 μm or less, fewer point defects occur in an image than when recesses having an aperture size of more than 400 μm are present.

In the outer peripheral surface of the conductive support, recesses having an aperture size of more than 400 μm and recesses having an aspect ratio of more than 0.12 μm or about 0.12 μm are preferably both absent. That is to say, the maximum aperture size is preferably 400 μm or less, and the maximum aspect ratio is preferably 0.12 or less or about 0.12 or less.

The maximum height of the conductive support, and the aperture size and the aspect ratio of the recesses in the outer peripheral surface of the conductive support are controlled by selecting processing conditions, for example, impact pressing conditions when the conductive support is an impact-pressed product. Specifically, the maximum height of the conductive support, the maximum aspect ratio of the recesses, and the maximum aperture size of the recesses are controlled, for example, by adjusting the amount of lubricant applied to the surface of the metal slug and controlling the crystal grain size near the surface of the metal slug.

Alternatively, the surface of conductive supports that have been through a formation process may be examined to select a conductive support having a maximum height within the above range and having recesses that have a maximum aspect ratio and a maximum aperture size within the above ranges.

Single-Layer Photosensitive Layer

The single-layer photosensitive layer includes, for example, a binder resin, a charge generation material, and a charge transport material including a hole transport material and an electron transport material, and may optionally include other additives.

Binder Resin

Examples of the binder resin include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilanes. These binder resins may be used alone or in combination.

Of these binder resins, polycarbonate resins and polyarylate resins are preferable from the viewpoint of, for example, the mechanical strength of the photosensitive layer.

To control the modulus of elasticity of the single-layer photosensitive layer to be 4.5 GPa or about 4.5 GPa, the binder resin is preferably a polycarbonate resin.

From the viewpoint of formability of the photosensitive layer, at least one of a polycarbonate resin having a viscosity-average molecular weight of 30,000 or more and 80,000 or less and a polyarylate resin having a viscosity-average molecular weight of 30,000 or more and 80,000 or less may be used.

The viscosity-average molecular weight is measured by the following method. One gram of a resin is dissolved in 100 $cm^3$ of methylene chloride, and the specific viscosity ηsp of the resulting solution is measured with an Ubbelohde viscometer in a measurement environment at 25° C. A limiting viscosity [η] ($cm^3/g$) is determined from the formula $\eta sp/c=[\eta]+0.45\ [\eta]^2c$ (where c represents a concentration ($g/cm^3$)), and a viscosity-average molecular weight My is determined from the formula $[\eta]=1.23\times10^{-4}\ Mv^{0.83}$ given by H. Schnell.

The content of the binder resin relative to the total solid content of the photosensitive layer is, for example, 35% by weight or more and 60% by weight or less, preferably 40% by weight or more and 55% by weight or less.

Charge Generation Material

Examples of the charge generation material include azo pigments such as bisazo pigments and trisazo pigments; fused aromatic pigments such as dibromoanthanthrone; perylene pigments; pyrrolopyrrole pigments; phthalocyanine pigments; zinc oxide; and trigonal selenium.

Of these charge generation materials, metal phthalocyanine pigments and non-metal phthalocyanine pigments are suitable for exposure to near-infrared laser light. Specifically, for example, hydroxygallium phthalocyanine, chlorogallium phthalocyanine, dichlorotin phthalocyanine, and titanyl phthalocyanine are more preferable.

For exposure to near-ultraviolet laser light, charge generation materials including fused aromatic pigments such as dibromoanthanthrone, thioindigo pigments, porphyrazine compounds, zinc oxide, trigonal selenium, and bisazo pigments are suitable.

In other words, the charge generation material is preferably an inorganic pigment when a light source with an exposure wavelength of, for example, 380 nm or more and 500 nm or less is used, and is preferably a metal or non-metal phthalocyanine pigment when a light source with an exposure wavelength of 700 nm or more and 800 nm or less is used.

In particular, the charge generation material is preferably at least one selected from hydroxygallium phthalocyanine pigments and chlorogallium phthalocyanine pigments. These charge generation materials may be used alone or in combination. To increase the sensitivity of the photoreceptor, hydroxygallium phthalocyanine pigments are preferable.

When a hydroxygallium phthalocyanine pigment and a chlorogallium phthalocyanine pigment are used in combination, the hydroxygallium phthalocyanine pigment and the chlorogallium phthalocyanine pigment are preferably in a weight ratio of 9:1 to 3:7 (preferably 9:1 to 6:4).

The hydroxygallium phthalocyanine pigment is preferably, but not necessarily, a Type V hydroxygallium phthalocyanine pigment.

In particular, to provide higher dispersibility, the hydroxygallium phthalocyanine pigment is preferably, for example, a hydroxygallium phthalocyanine pigment having a maximum peak wavelength in the range of 810 nm to 839 nm in a spectral absorption spectrum in the wavelength range of 600 nm to 900 nm.

The above-described hydroxygallium phthalocyanine pigment having a maximum peak wavelength in the range of 810 nm to 839 nm preferably has an average particle size in a particular range and a BET specific surface area in a particular range. Specifically, the average particle size is preferably 0.20 μm or less, more preferably 0.01 μm or more and 0.15 μm or less. The BET specific surface area is preferably 45 $m^2/g$ or more, more preferably 50 $m^2/g$ or more, still more preferably 55 $m^2/g$ or more and 120 $m^2/g$ or less. The average particle size is a volume-average particle size measured using a laser diffraction/scattering particle size distribution analyzer (LA-700 manufactured by Horiba, Ltd). The BET specific surface area is measured by nitrogen purging using a flow-type automatic specific surface area analyzer (FlowSorb 112300 manufactured by Shimadzu Corporation).

The maximum particle size (maximum primary particle size) of the hydroxygallium phthalocyanine pigment is preferably 1.2 μm or less, more preferably 1.0 μm or less, still more preferably 0.3 μm or less.

The hydroxygallium phthalocyanine pigment preferably has an average particle size of 0.2 μm or less, a maximum particle size of 1.2 μm or less, and a BET specific surface area of 45 $m^2/g$ or more.

The hydroxygallium phthalocyanine pigment is preferably a Type V hydroxygallium phthalocyanine pigment having diffraction peaks at Bragg angles (2θ±0.2°) of at least 7.3°, 16.0°, 24.9°, and 28.0° in an X-ray diffraction spectrum obtained using a CuKα X-ray.

The chlorogallium phthalocyanine pigment is preferably a compound having diffraction peaks at Bragg angles (2θ±0.2°) of 7.4°, 16.6°, 25.5°, and 28.3° from the viewpoint of the sensitivity of the photosensitive layer. Preferable ranges of the maximum peak wavelength, the average particle size, the maximum particle size, and the BET specific surface area of the chlorogallium phthalocyanine pigment are the same as those of the hydroxygallium phthalocyanine pigment.

The charge generation materials may be used alone or in combination.

To prevent a ghost, the content of the charge generation material relative to the total solid content of the single-layer photosensitive layer is preferably 0.8% by weight or more and 5% by weight or less, more preferably 0.8% by weight or more and 4% by weight or less, still more preferably 0.8% by weight or more and 3% by weight or less.

When two or more charge generation materials are used, the content of the charge generation material described above refers to the total content of all the charge generation materials used.

Hole Transport Material

Examples of the hole transport material include, but are not limited to, oxadiazole derivatives such as 2,5-bis(p-diethylaminophenyl)-1,3,4-oxadiazole; pyrazoline derivatives such as 1,3,5-triphenyl-pyrazoline and 1-[pyridyl-(2)]-3-(p-diethylaminostyryl)-5-(p-diethylaminostyryl) pyrazoline; aromatic tertiary amino compounds such as triphenylamine, N,N'-bis(3,4-dimethylphenyl)biphenyl-4-amine, tri(p-methylphenyl)aminyl-4-amine, and dibenzylaniline; aromatic tertiary diamino compounds such as N,N'-bis(3-methylphenyl)-N,N'-diphenylbenzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone; quinazoline derivatives such as 2-phenyl-4-styryl-quinazoline; benzofuran derivatives such as 6-hydroxy-2,3-di(p-methoxyphenyl)benzofuran; α-stilbene derivatives such as p-(2,2-diphenylvinyl)-N,N-diphenylaniline; enamine derivatives; carbazole derivatives such as N-ethylcarbazole; poly-N-vinylcarbazole and derivatives thereof; and polymers having, in their principal chain or side chain, a group formed of any of the above compounds. These hole transport materials may be used alone or in combination.

Specific examples of the hole transport material include compounds represented by general formula (B-1), compounds represented by general formula (B-2), and compounds represented by general formula (1). Of these, hole transport materials represented by general formula (1) are suitable for use from the viewpoint of charge mobility.

(B-1)

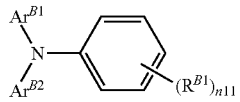

In general formula (B-1), $R^{B1}$ represents a hydrogen atom or a methyl group; n11 represents 1 or 2; $Ar^{B1}$ and $Ar^{B2}$ each independently represent a substituted or unsubstituted aryl group, $—C_6H_4—C(R^{B3})=C(R^{B4})(R^{B5})$, or $—C_6H_4—CH=CH—CH=C(R^{B6})(R^{B7})$; and $R^{B3}$ to $R^{B7}$ each independently represent a hydrogen atom, a substituted or unsubstituted alkyl group, or a substituted or unsubstituted aryl group. Examples of the substituent include halogen atoms, alkyl groups having from 1 to 5 carbon atoms, alkoxy groups having from 1 to 5 carbon atoms, and amino groups substituted with alkyl having from 1 to 3 carbon atoms.

(B-2)

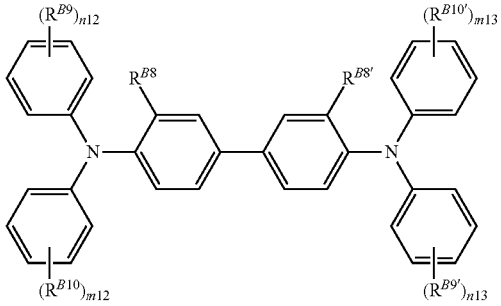

In general formula (B-2), $R^{B8}$ and $R^{B8'}$ may be the same or different and each independently represent a hydrogen atom, a halogen atom, an alkyl group having from 1 to 5 carbon atoms, or an alkoxy group having from 1 to 5 carbon atoms; $R^{B9}$, $R^{B9'}$, $R^{B10}$, and $R^{B10'}$ may be the same or different and each independently represent a halogen atom, an alkyl group having from 1 to 5 carbon atoms, an alkoxy group having from 1 to 5 carbon atoms, an amino group substituted with alkyl having from 1 to 2 carbon atoms, a substituted or unsubstituted aryl group, $—C(R^{B11})=C(R^{B12})(R^{B13})$, or $—CH=CH—CH=C(R^{B14})(R^{B15})$; $R^{B11}$ to $R^{B15}$ each independently represent a hydrogen atom, a substituted or unsubstituted alkyl group, or a substituted or unsubstituted aryl group; and m12, m13, n12, and n13 each independently represent an integer of from 0 to 2.

Among the compounds represented by general formula (B-1) and the compounds represented by general formula (B-2), compounds represented by general formula (B-1) having "—$C_6H_4$—CH═CH—CH═C($R^{B6}$) ($R^{B7}$)" and compounds represented by general formula (B-2) having "—CH═CH—CH═C($R^{B14}$) ($R^{B15}$)" are particularly preferable.

Specific examples of the compounds represented by general formula (B-1) and the compounds represented by general formula (B-2) include compounds represented by structural formulas (HT-A) to (HT-G), but the hole transport material is not limited thereto.

HT-A

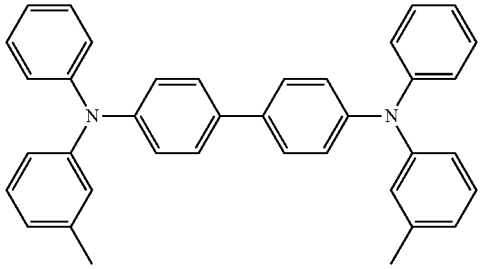

HT-B

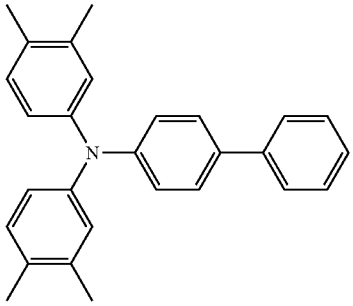

HT-C

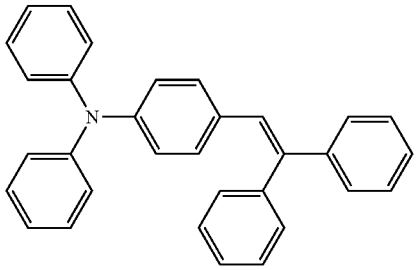

HT-D

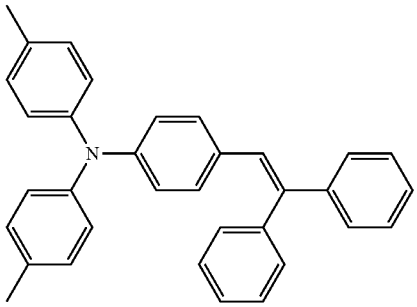

HT-E

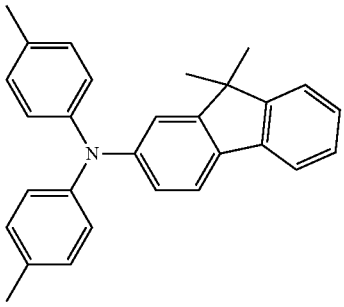

HT-F

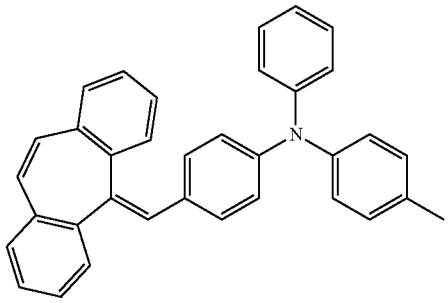

HT-G

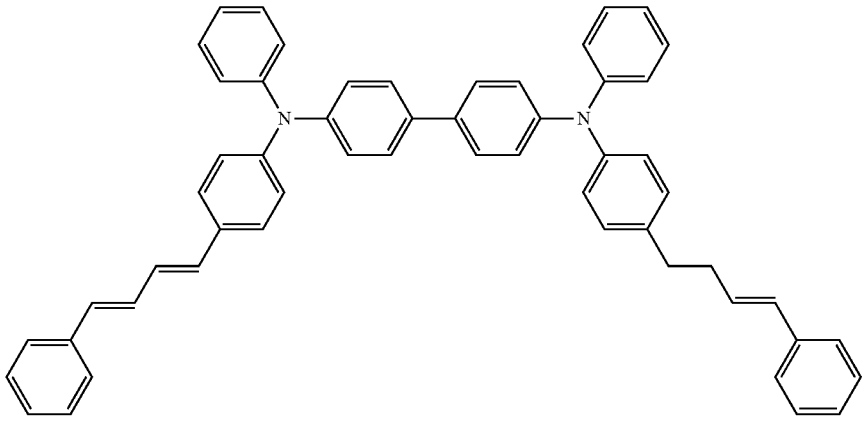

-continued (1)

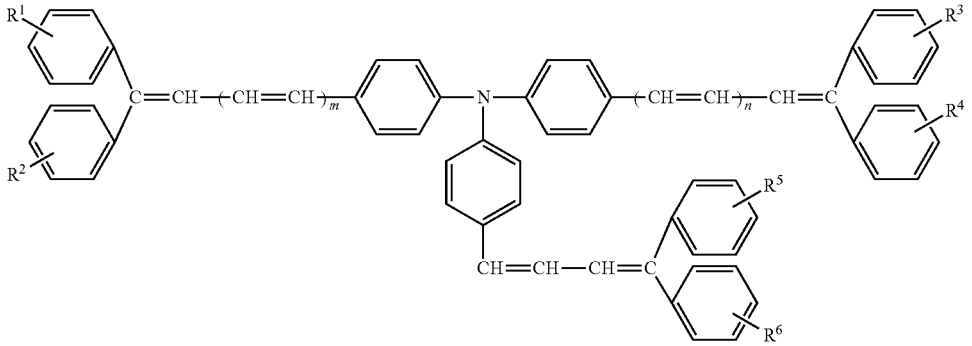

In general formula (1), $R^1$, $R^2$, $R^3$, $R^4$, $R^5$, and $R^6$ each independently represent a hydrogen atom, a lower alkyl group, an alkoxy group, a phenoxy group, a halogen atom, or a phenyl group optionally substituted with lower alkyl, lower alkoxy, or halogen; and m and n each independently represent 0 or 1.

Examples of the lower alkyl group represented by $R^1$ to $R^6$ in general formula (1) include linear and branched alkyl groups having from 1 to 4 carbon atoms: specifically, a methyl group, an ethyl group, an n-propyl group, an isopropyl group, an n-butyl group, and an isobutyl group.

Of these lower alkyl groups, a methyl group and an ethyl group are preferable.

Examples of the alkoxy group represented by $R^1$ to $R^6$ in general formula (1) include alkoxy groups having from 1 to 4 carbon atoms: specifically, a methoxy group, an ethoxy group, a propoxy group, and a butoxy group.

Examples of the halogen atom represented by $R^1$ to $R^6$ in general formula (1) include a fluorine atom, a chlorine atom, a bromine atom, and an iodine atom.

Examples of the phenyl group represented by $R^1$ to $R^6$ in general formula (1) include an unsubstituted phenyl group; phenyl groups substituted with lower alkyl, such as a p-tolyl group and a 2,4-dimethylphenyl group; phenyl groups substituted with lower alkoxy, such as a p-methoxyphenyl group; and phenyl groups substituted with halogen, such as a p-chlorophenyl group.

Examples of the substituent for the phenyl group include the lower alkyl groups, lower alkoxy groups, and halogen atoms represented by $R^1$ to $R^6$.

Among the hole transport materials represented by general formula (1), hole transport materials with m and n each representing 1 are preferable from the viewpoint of higher sensitivity, and hole transport materials with $R^1$ to $R^6$ each independently representing a hydrogen atom, a lower alkyl group having from 1 to 4 carbon atoms, or an alkoxy group, and m and n each representing 1 are more preferable.

Non-limiting examples of the compounds represented by general formula (1) include compounds (1-1) to (1-64) shown below. The numbers before substituents each represent a substitution position on a benzene ring. Exemplary Compounds are hereinafter expressed as Exemplary Compounds (1-[number]). Specifically, for example, Exemplary Compound 15 is hereinafter expressed as "Exemplary Compound (1-15)".

| Exemplary Compound | m | n | $R^1$ | $R^2$ | $R^3$ | $R^4$ | $R^5$ | $R^6$ |
|---|---|---|---|---|---|---|---|---|
| 1 | 1 | 1 | H | H | H | H | H | H |
| 2 | 1 | 1 | 4-Me | 4-Me | 4-Me | 4-Me | 4-Me | 4-Me |
| 3 | 1 | 1 | 4-Me | 4-Me | H | H | 4-Me | 4-Me |
| 4 | 1 | 1 | 4-Me | H | 4-Me | H | 4-Me | H |
| 5 | 1 | 1 | H | H | 4-Me | 4-Me | H | H |
| 6 | 1 | 1 | 3-Me | 3-Me | 3-Me | 3-Me | 3-Me | 3-Me |
| 7 | 1 | 1 | H | H | H | H | 4-Cl | 4-Cl |
| 8 | 1 | 1 | 4-MeO | H | 4-MeO | H | 4-MeO | H |
| 9 | 1 | 1 | H | H | H | H | 4-MeO | 4-MeO |
| 10 | 1 | 1 | 4-MeO | 4-MeO | 4-MeO | 4-MeO | 4-MeO | 4-MeO |
| 11 | 1 | 1 | 4-MeO | H | 4-MeO | H | 4-MeO | 4-MeO |
| 12 | 1 | 1 | 4-Me | H | 4-Me | H | 4-Me | 4-F |
| 13 | 1 | 1 | 3-Me | H | 3-Me | H | 3-Me | H |
| 14 | 1 | 1 | 4-Cl | H | 4-Cl | H | 4-Cl | H |
| 15 | 1 | 1 | 4-Cl | 4-Cl | 4-Cl | 4-Cl | 4-Cl | 4-Cl |
| 16 | 1 | 1 | 3-Me | 3-Me | 3-Me | 3-Me | 3-Me | 3-Me |
| 17 | 1 | 1 | 4-Me | 4-MeO | 4-Me | 4-MeO | 4-Me | 4-MeO |
| 18 | 1 | 1 | 3-Me | 4-MeO | 3-Me | 4-MeO | 3-Me | 4-MeO |
| 19 | 1 | 1 | 3-Me | 4-Cl | 3-Me | 4-Cl | 3-Me | 4-Cl |
| 20 | 1 | 1 | 4-Me | 4-Cl | 4-Me | 4-Cl | 4-Me | 4-Cl |
| 21 | 1 | 0 | H | H | H | H | H | H |
| 22 | 1 | 0 | 4-Me | 4-Me | 4-Me | 4-Me | 4-Me | 4-Me |
| 23 | 1 | 0 | 4-Me | 4-Me | H | H | 4-Me | 4-Me |
| 24 | 1 | 0 | H | H | 4-Me | 4-Me | H | H |
| 25 | 1 | 0 | H | H | 3-Me | 3-Me | H | H |
| 26 | 1 | 0 | H | H | 4-Cl | 4-Cl | H | H |
| 27 | 1 | 0 | 4-Me | H | H | H | 4-Me | H |

-continued

| Exemplary Compound | m | n | $R^1$ | $R^2$ | $R^3$ | $R^4$ | $R^5$ | $R^6$ |
|---|---|---|---|---|---|---|---|---|
| 28 | 1 | 0 | 4-MeO | H | H | H | 4-MeO | H |
| 29 | 1 | 0 | H | H | 4-MeO | 4-MeO | H | H |
| 30 | 1 | 0 | 4-MeO | 4-MeO | 4-MeO | 4-MeO | 4-MeO | 4-MeO |
| 31 | 1 | 0 | 4-MeO | H | 4-MeO | H | 4-MeO | 4-MeO |
| 32 | 1 | 0 | 4-Me | H | 4-Me | H | 4-Me | 4-F |
| 33 | 1 | 0 | 3-Me | H | 3-Me | H | 3-Me | H |
| 34 | 1 | 0 | 4-Cl | H | 4-Cl | H | 4-Cl | H |
| 35 | 1 | 0 | 4-Cl | 4-Cl | 4-Cl | 4-Cl | 4-Cl | 4-Cl |
| 36 | 1 | 0 | 3-Me | 3-Me | 3-Me | 3-Me | 3-Me | 3-Me |
| 37 | 1 | 0 | 4-Me | 4-MeO | 4-Me | 4-MeO | 4-Me | 4-MeO |
| 38 | 1 | 0 | 3-Me | 4-MeO | 3-Me | 4-MeO | 3-Me | 4-MeO |
| 39 | 1 | 0 | 3-Me | 4-Cl | 3-Me | 4-Cl | 3-Me | 4-Cl |
| 40 | 1 | 0 | 4-Me | 4-Cl | 4-Me | 4-Cl | 4-Me | 4-Cl |
| 41 | 0 | 0 | H | H | H | H | H | H |
| 42 | 0 | 0 | 4-Me | 4-Me | 4-Me | 4-Me | 4-Me | 4-Me |
| 43 | 0 | 0 | 4-Me | 4-Me | 4-Me | 4-Me | H | H |
| 44 | 0 | 0 | 4-Me | H | 4-Me | H | H | H |
| 45 | 0 | 0 | H | H | H | H | 4-Me | 4-Me |
| 46 | 0 | 0 | 3-Me | 3-Me | 3-Me | 3-Me | H | H |
| 47 | 0 | 0 | H | H | H | H | 4-Cl | 4-Cl |
| 48 | 0 | 0 | 4-MeO | H | 4-MeO | H | H | H |
| 49 | 0 | 0 | H | H | H | H | 4-MeO | 4-MeO |
| 50 | 0 | 0 | 4-MeO | 4-MeO | 4-MeO | 4-MeO | 4-MeO | 4-MeO |
| 51 | 0 | 0 | 4-MeO | H | 4-MeO | H | 4-MeO | 4-MeO |
| 52 | 0 | 0 | 4-Me | H | 4-Me | H | 4-Me | 4-F |
| 53 | 0 | 0 | 3-Me | H | 3-Me | H | 3-Me | H |
| 54 | 0 | 0 | 4-Cl | H | 4-Cl | H | 4-Cl | H |
| 55 | 0 | 0 | 4-Cl | 4-Cl | 4-Cl | 4-Cl | 4-Cl | 4-Cl |
| 56 | 0 | 0 | 3-Me | 3-Me | 3-Me | 3-Me | 3-Me | 3-Me |
| 57 | 0 | 0 | 4-Me | 4-MeO | 4-Me | 4-MeO | 4-Me | 4-MeO |
| 58 | 0 | 0 | 3-Me | 4-MeO | 3-Me | 4-MeO | 3-Me | 4-MeO |
| 59 | 0 | 0 | 3-Me | 4-Cl | 3-Me | 4-Cl | 3-Me | 4-Cl |
| 60 | 0 | 0 | 4-Me | 4-Cl | 4-Me | 4-Cl | 4-Me | 4-Cl |
| 61 | 1 | 1 | 4-Pr | 4-Pr | 4-Pr | 4-Pr | 4-Pr | 4-Pr |
| 62 | 1 | 1 | 4-PhO | 4-PhO | 4-PhO | 4-PhO | 4-PhO | 4-PhO |
| 63 | 1 | 1 | H | 4-Me | H | 4-Me | H | 4-Me |
| 64 | 1 | 1 | $4\text{-}C_6H_5$ | $4\text{-}C_6H_5$ | $4\text{-}C_6H_5$ | $4\text{-}C_6H_5$ | $4\text{-}C_6H_5$ | $4\text{-}C_6H_5$ |

The abbreviations in the above Exemplary Compounds stand for the following.

4-Me: Methyl substituent at 4-position of phenyl group

3-Me: Methyl substituent at 3-position of phenyl group

4-Cl: Chlorine substituent at 4-position of phenyl group

4-MeO: Methoxy substituent at 4-position of phenyl group

4-F: Fluorine substituent at 4-position of phenyl group

4-Pr: Propyl substituent at 4-position of phenyl group

4-PhO: Phenoxy substituent at 4-position of phenyl group

Electron Transport Material

Examples of the electron transport material include, but are not limited to, quinone compounds such as chloranil and bromanil; tetracyanoquinodimethane compounds; fluorenone compounds such as 2,4,7-trinitro-9-fluorenone, 2,4,5,7-tetranitro-9-fluorenone, and octyl 9-dicyanomethylene-9-fluorenone-4-carboxylate; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; dinaphthoquinone compounds such as 3,3'-di-tert-pentyl-dinaphthoquinone; diphenoquinone compounds such as 3,3'-di-tert-butyl-5,5'-dimethyldiphenoquinone and 3,3',5,5'-tetra-tert-butyl-4,4'-diphenoquinone; and polymers having, in their principal chain or side chain, a group formed of any of the above compounds. These electron transport materials may be used alone or in combination.

To provide high sensitivity, the electron transport material is preferably a compound represented by general formula (2).

(2)

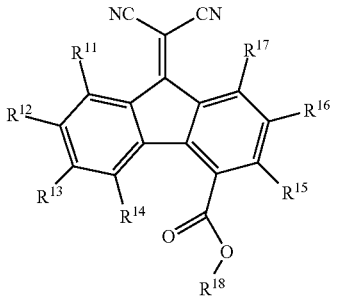

In general formula (2), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group. $R^{11}$ represents an alkyl group, $-L^{19}-O-R^{20}$, an aryl group, or an aralkyl group. $L^{19}$ represents an alkylene group and $R^{20}$ represents an alkyl group.

Examples of the halogen atom represented by $R^{11}$ to $R^{17}$ in general formula (2) include a fluorine atom, a chlorine atom, a bromine atom, and an iodine atom.

Examples of the alkyl group represented by $R^{11}$ to $R^{17}$ in general formula (2) include linear and branched alkyl groups having from 1 to 4 (preferably from 1 to 3) carbon atoms: specifically, a methyl group, an ethyl group, an n-propyl group, an isopropyl group, an n-butyl group, an isobutyl group.

Examples of the alkoxy group represented by $R^{11}$ to $R^{17}$ in general formula (2) include alkoxy groups having from 1 to 4 (preferably from 1 to 3) carbon atoms: specifically, a methoxy group, an ethoxy group, a propoxy group, and a butoxy group.

Examples of the aryl group represented by $R^{11}$ to $R^{17}$ in general formula (2) include a phenyl group and a tolyl group. Of these aryl groups represented by $R^{11}$ to $R^{17}$, a phenyl group is preferable.

Examples of the aralkyl group represented by $R^{11}$ to $R^{17}$ in general formula (2) include a benzyl group, a phenethyl group, and a phenylpropyl group.

Examples of the alkyl group represented by $R^{17}$ in general formula (2) include linear alkyl groups having from 1 to 12 carbon atoms (preferably from 5 to 10 carbon atoms) and branched alkyl groups having from 3 to 10 carbon atoms (preferably from 5 to 10 carbon atoms).

Examples of the linear alkyl groups having from 1 to 12 carbon atoms include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, and an n-dodecyl group.

Examples of the branched alkyl groups having from 3 to 10 carbon atoms include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

In the group represented by $-L^{19}-O-R^{20}$ represented by $R^{18}$ in general formula (2), $L^{19}$ represents an alkylene group and $R^{20}$ represents an alkyl group.

Examples of the alkylene group represented by $L^{19}$ include linear and branched alkylene groups having from 1 to 12 carbon atoms: specifically, a methylene group, an ethylene group, an n-propylene group, an isopropylene group, an n-butylene group, an isobutylene group, a sec-butylene group, a tert-butylene group, an n-pentylene group, an isopentylene group, a neopentylene group, and a tert-pentylene group.

Examples of the alkyl group represented by $R^{20}$ include the same groups as the alkyl groups represented by $R^{11}$ to $R^{17}$.

Examples of the aryl group represented by $R^{18}$ in general formula (2) include a phenyl group, a methylphenyl group, a dimethylphenyl group, and an ethylphenyl group.

The aryl group represented by $R^{18}$ is preferably an alkyl-substituted aryl group from the viewpoint of solubility. Examples of the alkyl group of the alkyl-substituted aryl group include the same groups as the alkyl groups represented by $R^{11}$ to $R^{17}$.

Examples of the aralkyl group represented by $R^{18}$ in general formula (2) include groups represented by $-L^{21}-Ar$, where $L^{21}$ represents an alkylene group and Ar represents an aryl group.

Examples of the alkylene group represented by $L^{21}$ include linear and branched alkylene groups having from 1 to 12 carbon atoms: specifically, a methylene group, an ethylene group, an n-propylene group, an isopropylene group, an n-butylene group, an isobutylene group, a sec-butylene group, a tert-butylene group, an n-pentylene group, an isopentylene group, a neopentylene group, and a tert-pentylene group.

Examples of the aryl group represented by Ar include a phenyl group, a methylphenyl group, a dimethylphenyl group, and an ethylphenyl group.

Specific examples of the aralkyl group represented by $R^{18}$ in general formula (2) include a benzyl group, a methylbenzyl group, a dimethylbenzyl group, a phenylethyl group, a methylphenylethyl group, a phenylpropyl group, and a phenylbutyl group.

To provide higher sensitivity, the electron transport material represented by general formula (2) is preferably an electron transport material with $R^{18}$ representing an alkyl group having from 5 to 10 carbon atoms or an aralkyl group, and particularly preferably an electron transport material with $R^{11}$ to $R^{17}$ each independently representing a hydrogen atom, a halogen atom, or an alkyl group, and $R^{18}$ representing an alkyl group having from 5 to 10 carbon atoms or an aralkyl group.

Exemplary Compounds of the electron transport material represented by general formula (2) are shown below, but these are non-limiting examples. Exemplary Compounds are hereinafter expressed as Exemplary Compounds (2-[number]). Specifically, for example, Exemplary Compound 15 is hereinafter expressed as "Exemplary Compound (2-15)".

| Exemplary Compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| 1 | H | H | H | H | H | H | H | $-n-C_7H_{15}$ |
| 2 | H | H | H | H | H | H | H | $-n-C_8H_{17}$ |
| 3 | H | H | H | H | H | H | H | $-n-C_5H_{11}$ |
| 4 | H | H | H | H | H | H | H | $-n-C_{10}H_{21}$ |
| 5 | Cl | Cl | Cl | Cl | Cl | Cl | Cl | $-n-C_7H_{15}$ |
| 6 | H | Cl | H | Cl | H | Cl | Cl | $-n-C_7H_{15}$ |
| 7 | $CH_3$ | $CH_3$ | $CH_3$ | $CH_3$ | $CH_3$ | $CH_3$ | $CH_3$ | $-n-C_7H_{15}$ |
| 8 | $C_4H_9$ | $C_4H_9$ | $C_4H_9$ | $C_4H_9$ | $C_4H_9$ | $C_4H_9$ | $C_4H_9$ | $-n-C_7H_{15}$ |
| 9 | $CH_3O$ | H | $CH_3O$ | H | $CH_3O$ | H | $CH_3O$ | $-n-C_8H_{17}$ |
| 10 | $C_6H_5$ | $C_6H_5$ | $C_6H_5$ | $C_6H_5$ | $C_6H_5$ | $C_6H_5$ | $C_6H_5$ | $-n-C_8H_{17}$ |
| 11 | H | H | H | H | H | H | H | $-n-C_4H_5$ |
| 12 | H | H | H | H | H | H | H | $-n-C_{11}H_{23}$ |
| 13 | H | H | H | H | H | H | H | $-n-C_9H_{19}$ |
| 14 | H | H | H | H | H | H | H | $—CH_2—CH(C_2H_5)—C_4H_9$ |
| 15 | H | H | H | H | H | H | H | $—(CH_2)_2—Ph$ |
| 16 | H | H | H | H | H | H | H | $—CH_2—Ph$ |
| 17 | H | H | H | H | H | H | H | $-n-C_{12}H_{25}$ |
| 18 | H | H | H | H | H | H | H | $—C_2H_4—O—CH_3$ |

The abbreviations in the above Exemplary Compounds stand for the following.

Ph: Phenyl group

Specific examples of the electron transport material include, in addition to the electron transport materials represented by general formula (2), compounds represented by structural formulas (ET-A) to (ET-E).

ET-A

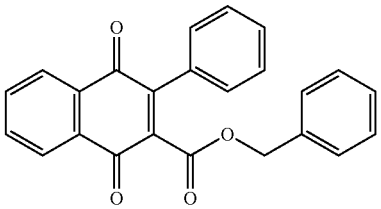

ET-B

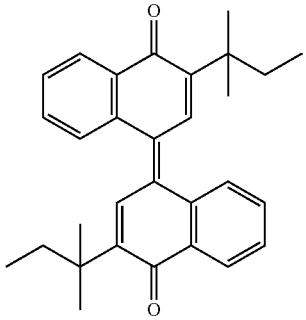

ET-C

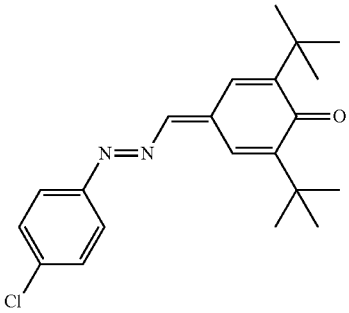

ET-D

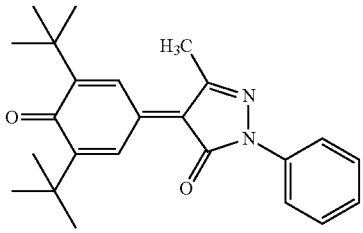

ET-E

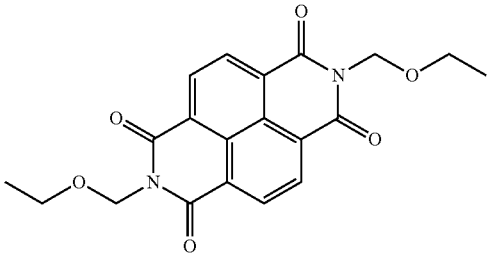

The electron transport materials represented by general formula (2) may be used alone or in combination. When an electron transport material represented by general formula (2) is used, the electron transport material represented by general formula (2) and an electron transport material (e.g., an electron transport material formed of a compound represented by any of the structural formulas (ET-A) to (ET-E)) other than the electron transport material represented by general formula (2) may be used in combination.

When an electron transport material other than the electron transport material represented by general formula (2) is used, the content thereof is preferably in the range of 10% by weight or less of the total amount of electron transport material.

The total content of electron transport material relative to the total solid content of the photosensitive layer may be 4% by weight or more and 30% by weight or less, and is preferably 6% by weight or more and 20% by weight or less.

Weight Ratio of Hole Transport Material to Electron Transport Material

The weight ratio of the hole transport material to the electron transport material (hole transport material/electron transport material) is preferably from 50/50 to 90/10, more preferably from 60/40 to 80/20.

Other Additives

The single-layer photosensitive layer may contain known additives such as an antioxidant, a light stabilizer, a heat stabilizer, fluorocarbon resin particles, and silicone oil.

From the viewpoint of suppressing the formation of color spots, the single-layer photosensitive layer of the photoreceptor according to the exemplary embodiment preferably contains at least one charge generation material selected from the hydroxygallium phthalocyanine pigments and the chlorogallium phthalocyanine pigments described above, a hole transport material, and the electron transport material represented by general formula (2). From the same viewpoint, the single-layer photosensitive layer preferably contains the hole transport material represented by general formula (1) as a hole transport material, in addition to the at least one charge generation material and the electron transport material represented by general formula (2).

Formation of Single-Layer Photosensitive Layer

The single-layer photosensitive layer is formed using a coating liquid for forming a photosensitive layer, the coating liquid being prepared by adding the above-described components to a solvent. Specifically, for example, the coating liquid for forming a photosensitive layer is applied to a conductive support to form a coating layer, and the coating layer is dried and optionally heated to form a single-layer photosensitive layer.

Examples of the solvent include commonly used organic solvents including aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic and linear ethers such as tetrahydrofuran and ethyl ether. These solvents may be used alone or in combination.

When particles (e.g., a charge generation material) is dispersed in the coating liquid for forming a photosensitive layer, a media dispersing device such as a ball mill, a vibration ball mill, an attritor, a sand mill, or a horizontal sand mill, or a media-less dispersing device such as a stirrer, an ultrasonic dispersing device, a roll mill, or a high-pressure homogenizer is used. Examples of the high-pressure homogenizer include an impact-type homogenizer in which a dispersion is dispersed through liquid-liquid collision or liquid-wall collision under a high pressure and a pass-through-type homogenizer in which a dispersion is dispersed by forcing the dispersion to pass through a narrow flow path under a high pressure.

Examples of the method of applying the coating liquid for forming a photosensitive layer include dip coating, push-up coating, wire bar coating, spray coating, blade coating, knife coating, and curtain coating.

Properties of Single-Layer Photosensitive Layer

To prevent or reduce point defects, the thickness of the single-layer photosensitive layer is 20 μm or more or about 20 μm or more as described above, preferably 20 μm or more and 40 μm or less, or about 20 μm or more and about 40 μm or less. A thickness of the single-layer photosensitive layer in this range provides greater benefits for developability and transferability than a thickness higher than this range. To prevent or reduce point defects, the thickness of the single-layer photosensitive layer is set to be in the range of, more preferably, 20 μm or more and 35 μm or less, or about 20 μm or more and about 35 μm or less, still more preferably, 20 μm or more and 30 μm or less, or about 20 μm or more and about 30 μm or less.

The thickness of the single-layer photosensitive layer is controlled by adjusting the thickness of the coating layer of the coating liquid for forming a photosensitive layer.

The thickness is measured using, for example, an eddy-current thickness gauge (FISCHER INSTRUMENTS).

To prevent or reduce point defects, the modulus of elasticity of the single-layer photosensitive layer is 4.5 GPa or more or about 4.5 GPa or more as described above, preferably 4.5 GPa or more and 5.0 GPa or less, or about 4.5 GPa or more and about 5.0 GPa or less. A modulus of elasticity of the single-layer photosensitive layer in this range provides greater benefits for surface refreshing properties than a modulus of elasticity higher than this range. To prevent or reduce point defects, the modulus of elasticity of the single-layer photosensitive layer is set to be in the range of, more preferably, 4.6 GPa or more and 5.0 GPa or less, or about 4.6 GPa or more and about 5.0 GPa or less, still more preferably, 4.7 GPa or more and 5.0 GPa or less, or about 4.7 GPa or more and about 5.0 GPa or less.

The modulus of elasticity of the single-layer photosensitive layer may be controlled by the selection of the type of binder resin for use or by the conditions for drying the coating layer of the coating liquid for forming a photosensitive layer (specifically, for example, drying temperature and drying time). In other words, by adjusting the drying temperature and drying time during the process of drying the coating layer, the drying rate of the coating layer may be controlled, thereby controlling the modulus of elasticity of the resulting photosensitive layer. The drying temperature may be, for example, 110° C. or higher and 150° C. or lower, and the drying time may be, for example, 10 minutes or longer and 40 minutes or shorter.

The modulus of elasticity of the single-layer photosensitive layer is measured as described below. Specifically, a part of the target photosensitive layer is cut to 5 mm×20 mm with a cutter or the like to prepare a measurement sample. The modulus of elasticity of the measurement sample is measured using a DMS visco-elastometer manufactured by Seiko Instruments Inc. under the conditions of a measurement environment of 40° C. and a frequency of 0.5 Hz.

The center line average roughness (Ra) of the outer peripheral surface of the single-layer photosensitive layer (hereinafter also referred to simply as the "average roughness of the photosensitive layer") is preferably 0.05 μm or more and 0.3 μm or less, or about 0.05 μm or more and about 0.3 μm or less. An average roughness of the photosensitive layer in this range causes fewer point defects in an image than an average roughness higher than this range. To prevent or reduce point defects, the average roughness of the photosensitive layer is more preferably 0.05 μm or more and 0.25 μm or less, or about 0.05 μm or more and about 0.25 μm or less, still more preferably 0.05 μm or more and 0.2 μm or less, or about 0.05 μm or more and about 0.2 μm or less.

The average roughness of the photosensitive layer is a "center line average roughness (Ra)" specified in JIS B0601 (1982). The average roughness of the photosensitive layer is measured using a SURFCOM 1400A surface roughness meter (Tokyo Seimitsu Co., Ltd.) in accordance with JIS B0601 (1982) under the following conditions: evaluation length Ln=4.0 mm, sampling length L=0.8 mm, cutoff value=0.8 mm.

The maximum value of the aspect ratio of recesses in the outer peripheral surface of the single-layer photosensitive layer is preferably 0.030 or less, more preferably 0.025 or less, still more preferably 0.020 or less.

The maximum value of the aperture size of recesses in the outer peripheral surface of the single-layer photosensitive layer is preferably 540 μm or less, more preferably 535 μm or less, still more preferably 530 μm or less.

Image-Forming Apparatus (and Process Cartridge)

An image-forming apparatus according to an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image formed on the surface of the electrophotographic photoreceptor with a developer containing a toner to form a toner image, and a transfer unit that transfers the toner image to a surface of a recording medium. The above-described electrophotographic photoreceptor according to the exemplary embodiment is used as the electrophotographic photoreceptor.

The image-forming apparatus according to the exemplary embodiment is applicable to well-known image-forming apparatuses: for example, an apparatus including a fixing unit that fixes a toner image transferred to a surface of a recording medium; a direct-transfer-type apparatus that directly transfers a toner image formed on a surface of an electrophotographic photoreceptor to a recording medium; an intermediate-transfer-type apparatus that transfers a toner image formed on a surface of an electrophotographic photoreceptor to a surface of an intermediate transfer body (first transfer) and subsequently transfers the toner image transferred to the surface of the intermediate transfer body to a surface of a recording medium (second transfer); an apparatus including a cleaning unit that cleans a surface of an electrophotographic photoreceptor before being charged after a toner image has been transferred; an apparatus including a charge-erasing unit that erases charge by irradiating a surface of an electrophotographic photoreceptor with charge-erasing light after a toner image has been transferred and before charging; and an apparatus including a member that heats an electrophotographic photoreceptor to increase the temperature of the electrophotographic photoreceptor and decrease the relative temperature.

When the image-forming apparatus according to the exemplary embodiment is applied to the intermediate-transfer-type apparatus, the transfer unit includes, for example, an intermediate transfer body having a surface to which a toner image is transferred, a first transfer unit that transfers a toner image formed on a surface of an electrophotographic photoreceptor to a surface of the intermediate transfer body (first transfer), and a second transfer unit that transfers the toner image transferred to the surface of the intermediate transfer body to a surface of a recording medium (second transfer).

The image-forming apparatus according to the exemplary embodiment may be a dry-developing image-forming apparatus or a wet-developing (a mode of development using a liquid developer) image-forming apparatus.

In the image-forming apparatus according to the exemplary embodiment, a unit including an electrophotographic photoreceptor, for example, may have a cartridge structure (process cartridge) that is attachable to and detachable from the image-forming apparatus. For example, the process cartridge is preferably a process cartridge including the electrophotographic photoreceptor according to the exemplary embodiment. The process cartridge may include, in addition to the electrophotographic photoreceptor, for example, at least one selected from a charging unit, an electrostatic latent image forming unit, a developing unit, and a transfer unit.

A non-limiting example of the image-forming apparatus according to the exemplary embodiment will now be described. Components shown in the drawings will be described, and other components will not be described.

Figure 4:
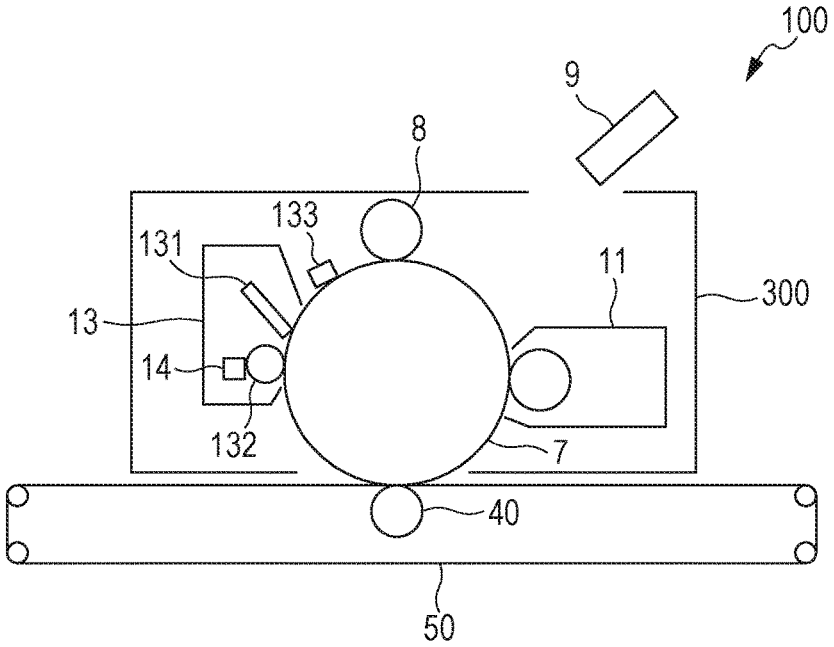
FIG. 4 schematically illustrates an example of an image-forming apparatus according to an exemplary embodiment.

FIG. 4 schematically illustrates an example of the image-forming apparatus according to the exemplary embodiment.

As shown in FIG. 4, an image-forming apparatus 100 according to the exemplary embodiment includes a process cartridge 300 including an electrophotographic photoreceptor 7, an exposure device 9 (an example of the electrostatic latent image forming unit), a transfer device 40 (first transfer device), and an intermediate transfer body 50. In the image-forming apparatus 100, the exposure device 9 is disposed such that the electrophotographic photoreceptor 7 may be exposed to light from the exposure device 9 through an opening in the process cartridge 300. The transfer device 40 is disposed so as to face the electrophotographic photoreceptor 7 with the intermediate transfer body 50 interposed therebetween. The intermediate transfer body 50 is disposed so as to be partially in contact with the electrophotographic photoreceptor 7 . The image-forming apparatus 100 further includes a second transfer device (not shown) that transfers a toner image transferred to the intermediate transfer body 50 to a recording medium (e.g., paper). The intermediate transfer body 50, the transfer device 40 (first transfer device), and the second transfer device (not shown) correspond to an example of the transfer unit.

The process cartridge 300 in FIG. 4 integrally supports, in a housing, the electrophotographic photoreceptor 7 , a charging device 8 (an example of the charging unit), a developing device 11 (an example of a developing unit), and a cleaning device 13 (an example of the cleaning unit). The cleaning device 13 includes a cleaning blade (an example of a cleaning member) 131. The cleaning blade 131 is disposed so as to be in contact with a surface of the electrophotographic photoreceptor 7 . The cleaning member need not necessarily be in the form of the cleaning blade 131 and may be a conductive or insulating fibrous member. The fibrous member may be used alone or in combination with the cleaning blade 131.

The image-forming apparatus illustrated in FIG. 4 includes a fibrous member 132 (roll-shaped) that supplies a lubricant 14 to the surface of the electrophotographic photoreceptor 7 and a fibrous member 133 (flat-brush-shaped) that assists cleaning. However, the fibrous member 132 and the fibrous member 133 are optional.

The components of the image-forming apparatus according to the exemplary embodiment will now be described.

Charging Device

The charging device 8 may be, for example, a contact charger including a conductive or semiconductive charging roller, a charging brush, a charging film, a charging rubber blade, a charging tube, or the like. The charging device 8 may also be a noncontact roller charger or a known charger such as a scorotron charger or a corotron charger which utilizes corona discharge.

Exposure Device

The exposure device 9 may be, for example, an optical device that emits light in a predetermined image pattern from a semiconductor laser, an LED, a liquid crystal shutter, or the like to the surface of the electrophotographic photoreceptor 7 . The wavelength of the light source is set to fall within the range of the spectral sensitivity of the electrophotographic photoreceptor. Semiconductor lasers commonly used are near-infrared lasers having an oscillation wavelength in the vicinity of 780 nm. However, the wavelength is not limited thereto, and lasers having an oscillation wavelength on the order of 600 nm and blue lasers having an oscillation wavelength of 400 nm or more and 450 nm or less may also be used. To form a color image, a surface-emitting laser source capable of emitting a multibeam is effective.

Developing Device

The developing device 11 may be, for example, a common developing device that performs development with a developer in a contact or non-contact manner. The developing device 11 may be any developing device as long as it has the above function, and is selected depending on the purpose. Examples of the developing device include known developing devices capable of depositing a one-component developer or a two-component developer on the electrophotographic photoreceptor 7 with a brush, a roller, or the like. In particular, a developing device including a developing roller carrying a developer on its surface is preferable.

The developer used in the developing device 11 may be a one-component developer containing a toner alone or a two-component developer containing a toner and a carrier. The developer may be magnetic or nonmagnetic. The developer may be a known developer.

Cleaning Device

The cleaning device 13 may be a cleaning-blade-type device including the cleaning blade 131.

Alternatively, the cleaning device 13 may be a fur-brush-cleaning-type device or a device that performs development and cleaning in parallel.

Transfer Device

The transfer device 40 may be, for example, a contact transfer charger including a belt, a roller, a film, a rubber blade, or the like, or a known transfer charger such as a scorotron transfer charger or a corotron transfer charger which utilizes corona discharge.

Intermediate Transfer Body

The intermediate transfer body 50 may be, for example, in the form of a belt (intermediate transfer belt) containing a polyimide, a polyamide-imide, a polycarbonate, a polyarylate, a polyester, rubber, or the like that is made semiconductive. The intermediate transfer body may be in the form of a drum as well as a belt.

Figure 5:
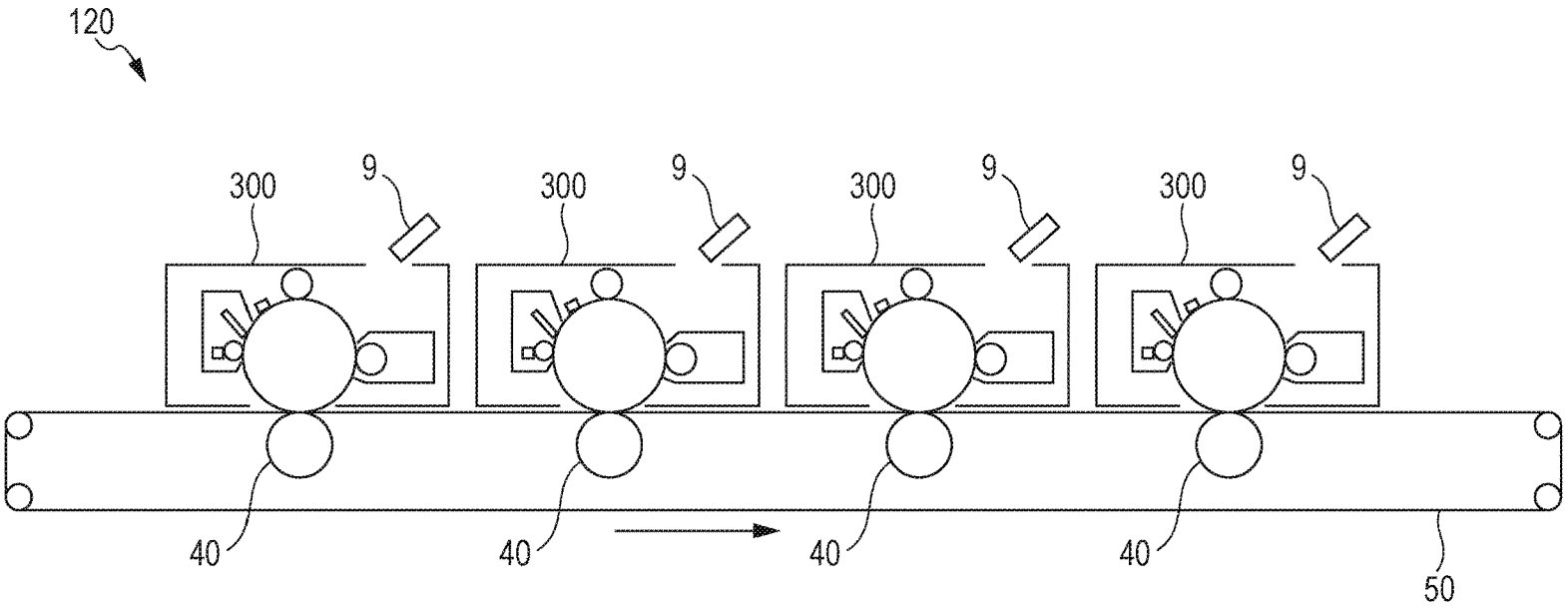
FIG. 5 schematically illustrates an example of an image-forming apparatus according to another exemplary embodiment.

FIG. 5 schematically illustrates another example of the image-forming apparatus according to the exemplary embodiment.

An image-forming apparatus 120 illustrated in FIG. 5 is a tandem-type multicolor-image-forming apparatus including four process cartridges 300. In the image-forming apparatus 120, the four process cartridges 300 are arranged in parallel to one another on an intermediate transfer body 50, and one electrophotographic photoreceptor is used for one color. The image-forming apparatus 120 has the same structure as that of the image-forming apparatus 100 except that the image-forming apparatus 120 is of tandem-type.

EXAMPLES

The exemplary embodiments of the invention will now be described in detail with reference to examples, but these examples are not intended to limit the exemplary embodiments of the invention.

Preparation of Conductive Support 1

A metal plate having a thickness of 14 mm (aluminum purity: 99.7% or more, JIS name: A1070 alloy) is die-cut to prepare a metal slug having a diameter of 34 mm and a thickness of 14 mm.

Magnesium stearate (N.P.-15005 available from Tannan Kagaku Kogyo Co., Ltd.), serving as a lubricant, is applied in an amount shown in Table 1 to the surface of the metal slug, and the metal slug is subjected to impact pressing to form a cylindrical tube having an outer diameter of 34 mm. The cylindrical tube is then subjected to ironing once, and the resulting cylindrical tube is cut at both ends and subjected to end face treatment to prepare a cylindrical tube (conductive support 1 ) having an outer diameter of 30 mm, a length of 244.5 mm, and a thickness of 0.5 mm.

Preparation of Conductive Supports 2 to 5

The same procedure as that for the conductive support 1 is performed to prepare conductive supports 2 to 5, except that the amount of lubricant and the thickness (wall thickness of conductive supports) are changed as shown in Table 1.

Measurement of Conductive Support

The maximum height of each conductive support (i.e., the maximum surface roughness height (Rmax) of the outer peripheral surface of each conductive support) is measured by the above-described method. The results are shown in Table 1 ("Rmax (μm)" in Table 1).

The whole outer peripheral surface of each conductive support is examined using the above-described automatic surface tester to obtain a recess distribution data. Recesses are located based on the recess distribution data, while recesses having an aperture size of 100 μm or more are measured for their aperture size and depth using a laser microscope. The dimension of a recess having a maximum aperture size and the dimension of a recess having a maximum aspect ratio are shown in Table 1.

TABLE 1

| | | | | Recess Having Maximum Aspect Ratio | | | Recess Having Maximum Aperture Size | | |
|---|---|---|---|---|---|---|---|---|---|
| Support | Amount of Lubricant (mg/cm2) | Thickness (mm) | Rmax (μm) | Aperture Size (μm) | Depth (μm) | Aspect Ratio | Aperture Size (μm) | Depth (μm) | Aspect Ratio |
| 1 | 0.3 | 0.5 | 3.5 | 125 | 10 | 0.08 | 350 | 12 | 0.03 |
| 2 | 0.2 | 0.5 | 3.0 | 150 | 9 | 0.06 | 365 | 11 | 0.03 |
| 3 | 0.3 | 0.3 | 3.0 | 115 | 7 | 0.06 | 280 | 9 | 0.03 |
| 4 | 0.3 | 0.7 | 5.0 | 130 | 14 | 0.11 | 370 | 15 | 0.04 |
| 5 | 0.1 | 0.5 | 4.5 | 80 | 12 | 0.15 | 290 | 14 | 0.05 |

Production of Photoreceptor 1

A mixture of 3 parts by weight of the hydroxygallium phthalocyanine pigment described below serving as a charge generation material, 47 parts by weight of a bisphenol Z polycarbonate resin (viscosity-average molecular weight: 50,000) serving as a binder resin, 15 parts by weight of the electron transport material represented by general formula (2) (Exemplary Compound (2-2)) serving as an electron transport material, 35 parts by weight of the hole transport material represented by general formula (B-1) (Exemplary Compound (HT-D)) serving as a hole transport material, and 250 parts by weight of tetrahydrofuran serving as a solvent is dispersed for 4 hours with a sand mill including glass beads having a diameter of 1 mm to thereby obtain a coating liquid for forming a photosensitive layer.

Charge Generation Material

HOGaPC (Type V): a Type V hydroxygallium phthalocyanine pigment having diffraction peaks at Bragg angles (20±0.2°) of at least 7.3°, 16.0°, 24.9°, and 28.0° in an X-ray diffraction spectrum obtained using a Cukα X-ray (maximum peak wavelength in a spectral absorption spectrum in the wavelength range of from 600 nm to 900 nm=820 nm, average particle size=0.12 μm, maximum particle size=0.2 μm, specific surface area value=60 $m^2/g$)

The coating liquid for forming a photosensitive layer is applied to the outer peripheral surface of the conductive support 1 by dip coating, and dried and cured at 140° C. for 30 minutes to form a single-layer photosensitive layer having a thickness of 25 μm.

In this manner, a photoreceptor 1 is produced.

Production of Photoreceptor 2

The same procedure as that for the photoreceptor 1 is performed to produce a photoreceptor 2 except that the thickness of the photosensitive layer is changed as shown in Table 2.

Production of Photoreceptor 3

The same procedure as that for the photoreceptor 1 is performed to produce a photoreceptor 3 except that the conductive support 1 is replaced with a conductive support 2.

Production of Photoreceptor 4

The same procedure as that for the photoreceptor 1 is performed to produce a photoreceptor 4 except that the drying and curing after the application of the coating liquid for forming a photosensitive layer is performed not at 140° C. for 30 minutes but at 130° C. for 30 minutes.

Production of Photoreceptor 5

The same procedure as that for the photoreceptor 1is performed to produce a photoreceptor 5 except that the conductive support 1 is replaced with a conductive support 3.

Production of Photoreceptor 6

The same procedure as that for the photoreceptor 1 is performed to produce a photoreceptor 6 except that the conductive support 1 is replaced with a conductive support 4.

Production of Photoreceptor 7

The same procedure as that for the photoreceptor 1 is performed to produce a photoreceptor 7 except that the conductive support 1 is replaced with a conductive support 5.

Production of Photoreceptor 8

The same procedure as that for the photoreceptor 1 is performed to produce a photoreceptor 8 except that the thickness of the photosensitive layer is changed as shown in Table 2.

Production of Photoreceptor 9

The same procedure as that for the photoreceptor 1 is performed to produce a photoreceptor 9 except that the drying and curing after the application of the coating liquid for forming a photosensitive layer is performed not at 140° C. for 30 minutes but at 150° C. for 30 minutes.

Measurement of Photoreceptor

The modulus of elasticity of the photosensitive layer of each photoreceptor is measured by the above-described method. The results are shown in Table 2 ("Modulus of elasticity (GPa)" in Table 2).

G4 (Poor): There is density unevenness of photoreceptor pitches (unacceptable level).

Evaluation Criteria of Point Defects

G1 (Excellent): No point defects are visually observed.

G2 (Good): Some point defects are visually observed, but at an acceptable level.

G3 (Fair): Point defects are visually observed, at an unacceptable level.

G4 (Poor): Distinct point defects are visually observed, at an unacceptable level.

After the above-described image quality evaluation is performed, each photoreceptor is taken out of the image-forming apparatus, and the layer (single-layer photosensitive layer) formed on the conductive support (outer peripheral surface) is visually evaluated for the state of cracking and peeling.

Evaluation Criteria of Cracking

G1 (Good): No cracking

G2 (Poor): Cracking is visually observable.

TABLE 2

| | | | Photosensitive Layer | | | | | | | |
|---|---|---|---|---|---|---|---|---|---|---|
| | Photore- | Conductive | Thickness | Modulus of Elasticity | Ra | Evaluation of Density Unevenness | | Evaluation of Point Defects | | |
| | ceptor | Support | (μm) | (GPa) | (μm) | Initial | 30,000th | Initial | 30,000th | Cracking |
| Example 1 | 1 | 1 | 25 | 4.6 | 0.15 | G1 (excellent) | G1 (excellent) | G1 (excellent) | G1 (excellent) | G1 (good) |
| Example 2 | 2 | 1 | 22 | 4.6 | 0.25 | G1 (excellent) | G1 (excellent) | G2 (good) | G2 (good) | G1 (good) |
| Example 3 | 3 | 2 | 25 | 4.6 | 0.1 | G2 (good) | G2 (good) | G2 (good) | G2 (good) | G1 (good) |
| Example 4 | 4 | 1 | 25 | 4.8 | 0.12 | G1 (excellent) | G1 (excellent) | G1 (excellent) | G1 (excellent) | G1 (good) |
| Example 5 | 5 | 3 | 25 | 4.6 | 0.08 | G3 (fair) | G3 (fair) | G2 (good) | G2 (good) | G1 (good) |
| Comparative Example 1 | 6 | 4 | 25 | 4.6 | 0.32 | G1 (excellent) | G1 (excellent) | G3 (fair) | G3 (fair) | G2 (poor) |
| Comparative Example 2 | 7 | 5 | 25 | 4.6 | 0.45 | G1 (excellent) | G1 (excellent) | G4 (poor) | G4 (poor) | G1 (good) |
| Comparative Example 3 | 8 | 1 | 18 | 4.6 | 0.4 | G1 (excellent) | G1 (excellent) | G4 (Poor) | G4 (poor) | G1 (good) |
| Comparative Example 4 | 9 | 1 | 25 | 4.4 | 0.35 | G1 (excellent) | G1 (excellent) | G4 (Poor) | G4 (poor) | G1 (good) |

The center line average roughness (Ra) of the outer peripheral surface of the photosensitive layer of each photoreceptor is measured by the above-described method. The results are shown in Table 2 ("Ra (μm)" in Table 2).

Evaluation of Photoreceptor

The electrophotographic photoreceptors are evaluated as described below. The results are shown in Table 2.

Image quality evaluation is performed in the following manner. Using a Brother HL5340D printer, a 50%-halftone image is printed on sheets in a high-temperature and high-humidity environment at 30° C. and 80% RH, and the quality of the initial (first) image and the 30,000th image are evaluated according to the following criteria.

Evaluation Criteria of Density Unevenness

G1 (Excellent): There is no density unevenness of photoreceptor pitches.

G2 (Good): There is very slight density unevenness of photoreceptor pitches (acceptable level).

G3 (Fair): There is slight density unevenness of photoreceptor pitches (acceptable level).

As may be seen from the above results, the occurrence of point defects in an image is prevented or reduced in Examples compared with Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive support having an outer peripheral surface with a maximum surface roughness height (Rmax) of about 4.0 μm or less and about 3.0 μm or more, the outer peripheral surface having a recess with a depth-to-aperture size ratio (depth/aperture size) of about 0.03 or more and about 0.12 or less; and a single-layer photosensitive layer disposed on the conductive support and having a thickness of about 20 μm or more and a modulus of elasticity of about 4.5 GPa or more, wherein the conductive support is hollow and has a wall thickness of about 0.8 mm or less.

2. The electrophotographic photoreceptor according to claim 1, wherein the conductive support is a conductive support having an outer peripheral surface having a recess with a depth-to-aperture size ratio (depth/aperture size) of about 0.06 or more and about 0.12 or less.

3. The electrophotographic photoreceptor according to claim 1, wherein the photosensitive layer has a modulus of elasticity of about 4.5 GPa or more and about 5.0 GPa or less.

4. The electrophotographic photoreceptor according to claim 1, wherein the photosensitive layer has a modulus of elasticity of about 4.6 GPa or more and about 5.0 GPa or less.

5. The electrophotographic photoreceptor according to claim 1, wherein the photosensitive layer has a modulus of elasticity of about 4.7 GPa or more and about 5.0 GPa or less.

6. The electrophotographic photoreceptor according to claim 1, wherein the photosensitive layer has an outer peripheral surface with a center line average roughness (Ra) of about 0.05 μm or more and about 0.3 μm or less.

7. The electrophotographic photoreceptor according to claim 1, wherein the photosensitive layer has an outer peripheral surface with a center line average roughness (Ra) of about 0.05 μm or more and about 0.2 μm or less.

8. The electrophotographic photoreceptor according to claim 1, wherein the conductive support has a wall thickness of about 0.4 mm or more and about 0.6 mm or less.

9. The electrophotographic photoreceptor according to claim 1, wherein the conductive support is an impact-pressed product.

10. The electrophotographic photoreceptor according to claim 9, wherein the conductive support is an ironed impact-pressed product.

11. A process cartridge comprising the electrophotographic photoreceptor according to claim 1, wherein the process cartridge is attachable to and detachable from an image-forming apparatus.

12. An image-forming apparatus comprising:

the electrophotographic photoreceptor according to claim 1;

a charging unit that charges a surface of the electrophotographic photoreceptor;

an electrostatic latent image forming unit that forms an electrostatic latent image on the charged surface of the electrophotographic photoreceptor;

a developing unit that develops the electrostatic latent image formed on the surface of the electrophotographic photoreceptor with a developer containing a toner to form a toner image; and a transfer unit that transfers the toner image to a surface of a recording medium.

* * * * *